United States Patent [19]

Scarato

[11] 4,228,331

[45] Oct. 14, 1980

[54] GAS-BLAST VALVE OF A GAS-BLAST CIRCUIT-BREAKER

[75] Inventor: Armand Scarato, Lyon, France

[73] Assignee: Société Anonyme Dite: Delle-Alsthom, Villeurbanne, France

[21] Appl. No.: 10,283

[22] Filed: Feb. 7, 1979

[51] Int. Cl.[3] ..... H01H 33/82

[52] U.S. Cl. ..... 200/144 R; 200/145; 200/148 H

[58] Field of Search ..... 200/148 R, 148 A, 148 B, 200/148 C, 148 D, 148 E, 148 F, 148 G, 148 H, 148 J, 148 BV, 145, 144 R

[56] References Cited

U.S. PATENT DOCUMENTS 3,573,411 4/1971 McKeough ..... 200/148 R

FOREIGN PATENT DOCUMENTS 85077 4/1965 France ..... 200/148 R

*Primary Examiner*—J. V. Truhe
*Assistant Examiner*—Morris Ginsburg
*Attorney, Agent, or Firm*—Sughrue, Rothwell, Mion, Zinn and MacPeak

[57] ABSTRACT

A gas-blast circuit-breaker which includes at least one cutout chamber including at least one blast valve with two seats, one of which, when the valve is opened, is situated on the blast-gas exit path. The breaker is characterized in that a moving slide valve is associated with the valve, in such a manner that opening the valve causes a slightly delayed movement of the slide valve in the same direction as the valve and along the same axis, so that it masks said valve seat situated on the exit path of the hot blast-gases arriving from extinguishing the arc when the blast-gases flow towards the outside; the slide valve being opened by compressed gas contained in the gas-blast circuit-breaker.

4 Claims, 3 Drawing Figures

GAS-BLAST VALVE OF A GAS-BLAST CIRCUIT-BREAKER

FIELD OF THE INVENTION

The present invention relates to a gas-blast valve for extinguishing an arc in a gas-blast circuit-breaker.

DESCRIPTION OF THE PRIOR ART

In known circuit-breakers, when a two seated compensated force gas-blast valve opens, one of the valve seats is on the exit path of the hot gases as they escape.

The invention aims to mitigate this disadvantage while saving blast air.

SUMMARY OF THE INVENTION

The invention therefore provides a gas-blast circuit-breaker which includes at least one cut-out chamber including at least one blast valve with two seats, one of which, when the valve is opened, is situated on the blast-gas exit path, characterized in that a moving slide valve is associated with the valve, in such a manner that opening the valve causes a slightly delayed movement of the slide valve in the same direction as the valve and along the same axis, so that it masks said valve seat situated on the exit path of the hot blast-gases arriving from extinguishing the arc when the blast-gases flow towards the outside, the slide valve being opened by compressed gas contained in the gas-blast circuit-breaker.

According to one embodiment of the invention said slide valve slides along a rod which carries a blast-gas deflector and in the rest position, by placing itself along the common axis of the valve and of the slide valve, the slide valve is placed beyond the valve so that the end of the slide valve masks said seat while the valve is opening is placed at the level of the bearing point of the valve against said seat.

BRIEF DESCRIPTION OF THE DRAWINGS

The invention will be better understood from the description of a preferred embodiment of the invention given hereinbelow with reference to the accompanying drawings in which.

DETAILED DESCRIPTION

Figure 1:
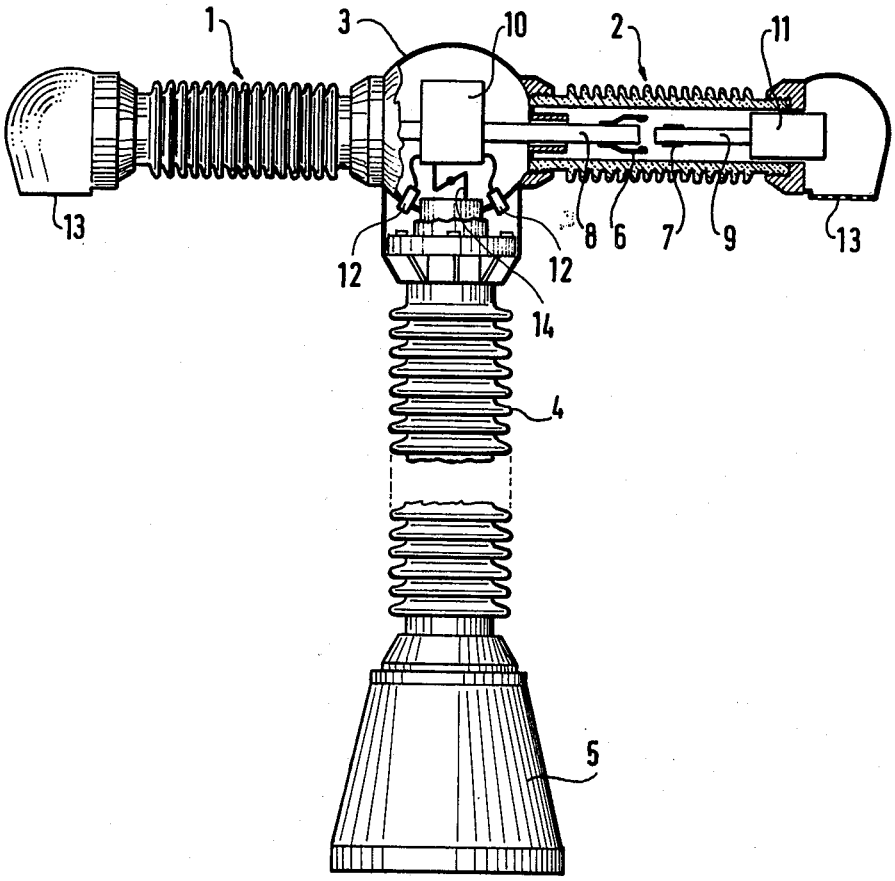
FIG. 1 illustrates schematically a gas-blast circuit-breaker.

With reference to FIG. 1, the circuit-breaker includes, in series, two arc-extinguishing chambers 1 and 2 connected by a central case 3. The assembly rests on a hollow ceramic insulating support 4 which rests on a base which includes a supply of compressed gas. Each of the chambers includes moving contacts 6 and stationary contacts 7 situated at the end of hollow conductive tubes 8, 9 which act as blast nozzles, a main valve 10, an auxiliary valve 11 and deflectors 12 and 13 for evacuating the gas.

The assembly is filled with compressed air: the hollow support 4, the central case 3, the arc-extinguishing chambers 1 and 2 and the interior of the blast nozzles 8, 9.

The main valve 10 is operated by a rod 14 and when it is open, the interior volume of the nozzles 8, 9 communicates with the outside air via the deflectors 12. This causes a pressure drop inside the nozzles and thus opens the auxiliary valve 11 and the moving contacts 6.

Figure 2:
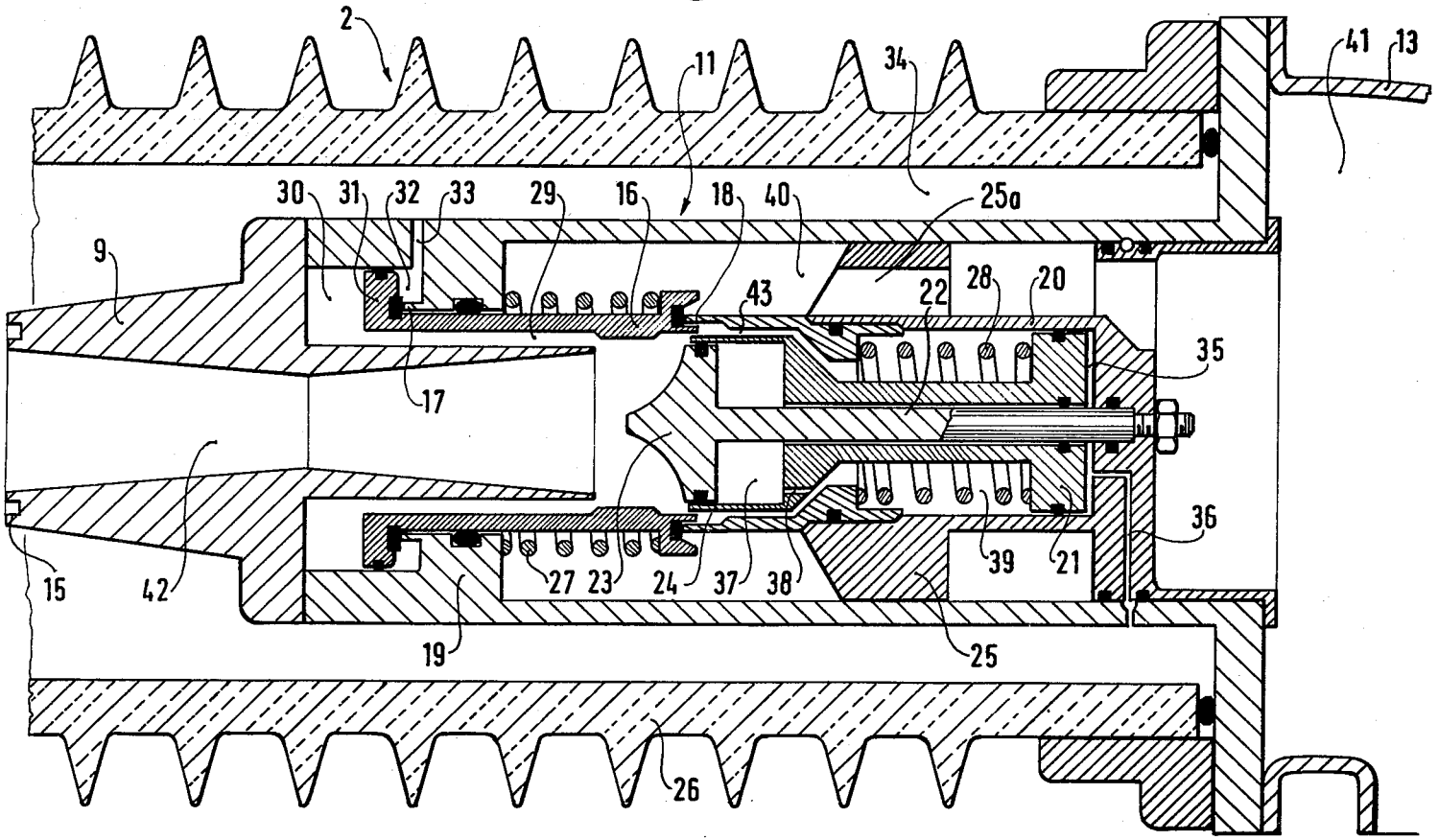
FIG. 2 illustrates a closed blast valve of the circuit-breaker of FIG. 1.
Figure 3:
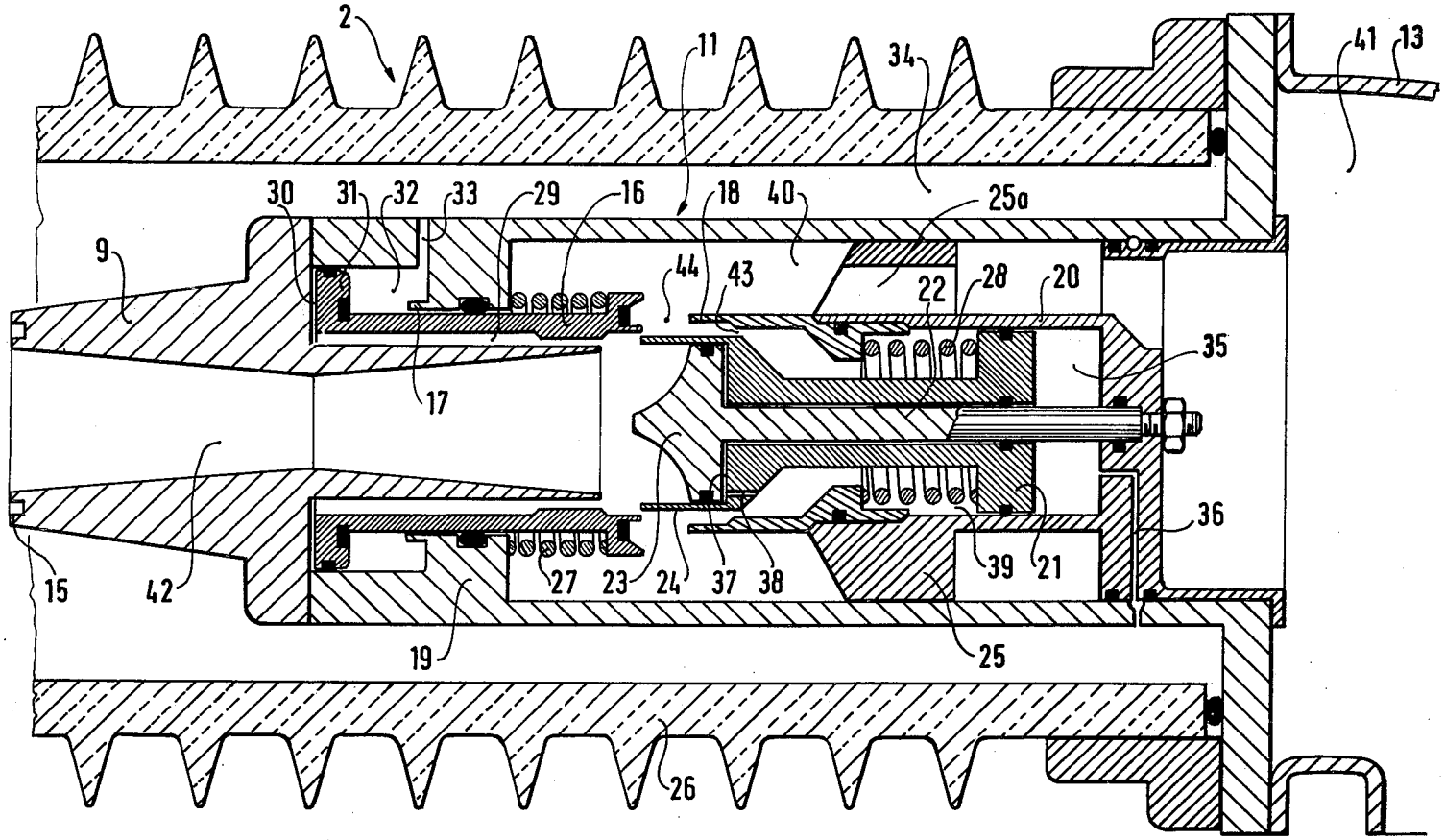
FIG.3 illustrates an open blast valve of the circuit-breaker of FIG. 2.

All this is known and the invention relates to the auxiliary valve 11 whose structure and operation will now be described with reference to FIGS. 2 and 3.

The stationary contacts 7 (not shown in these Figures) are installed on the end 15 of the hollow tube 9 which acts as a blast nozzle.

The assembly includes a gas blast valve 16 with two seats 17 and 18. The valve 16 slides in a stationary part 19 hereinafter referred to as the valve casing. The seat 17 is on the valve casing 19 and the seat 18 is on one end of a cylinder 20 inside which a piston or slide valve 21 can slide. The slide valve 21 is guided on a fixed rod at whose end there is a deflector 23. The slide valve 21 ends on the deflector 23 side in a cylindrical skirt 24 which covers the deflector 23. Distance pieces or spacers 25 center the cylinder 20 in the valve casing 19. The assembly is situated inside an arc-extinguishing chamber 2 whose outside wall 26 is made of an insulating ceramic. The arc-extinguishing chamber 2 ends on one side in a deflector 13 and on the other side it ends at the central casing 3 (FIG. 1). The valve 16 is provided with a return spring 27 and likewise, the slide valve 21 is fitted with a return spring 28. The blast nozzle 9 extends inside the valve 16 and leaves an annular space 29 between it and the tube 9, the annular space leading to an annular chamber 30. The end of the gas blast valve 16 which bears against the seat 17 forms a piston 31 on one of whose sides there is the chamber 30 and on whose other side there is a chamber 32 which communicates via a passage 33 with a large chamber 34 full of compressed blast gas.

At the back of the slide valve 21, there is a chamber 35 which communicates with the large chamber 34 via a calibrated bore 36.

Between the deflector 23 and the slide valve 21, a chamber 37 communicates via a passage 38 with a chamber 39. The space 40 situated between the valve casing 19 on one side and the valve 16 and the cylinder 20 on the other side communicates freely with the outside air at 41 via passage **25*a* within spacer 25**.

The operation of the device will now be described with reference firstly to FIG. 2 in which the gas blast valve 16 is closed and rests on both its seats 17 and 18. The chambers 30, 32, 34, 35, 37, 39, the inside of the blast nozzle 9, the annular space 29 and the hollow passage 42 are filled with blast air at operating pressure.

When a circuit-breaking command is received, the main valve 10 (FIG. 1) opens and therefore, the pressure drops in the hollow passage 42.

This pressure drop is communicated to the annular chamber 30 via the annular space 29. (Then the passage 42 and the large chamber 34 are substantially isolated from each other and only the withdrawal of the moving contacts 6 (FIG. 1) brings the large chamber 34 into communication with the hollow tube 42.) Since the pressure drops in the chamber 30, the return spring 27 no longer balances the pressure which is exerted in the chamber 32 and the valve 16 opens.

Simultaneously, the pressure drop in the tube 42 is communicated to the chamber 39 via the annular space between the skirt 24 of the slide valve 21 and the part of the cylinder 20 near the valve seat 18. Because of the pressure drop, the return spring 29 no longer balances the force generated by the pressure which prevails in the chamber 35 and the slide valve 21 slides so that the skirt 24 masks the seat 18 and even almost closes the passage 44 formed between valve 16 and its seat 18 when the valve opens. However, due to the calibrated bore 36, the movement of the slide valve 21 is slightly delayed in relation to the opening of the valve 16. Therefore, as soon as the valve 21 opens, the cold compressed air escapes through the passage 44, before the skirt masks the valve seat 18, but by the time the hot blast gases arrive from extinguishing the electric arc, the skirt 24 is in position masking the valve seat and thereby protects it. Lastly, at the end of the stroke, after the arc has been extinguished, the skirt 24, in its end position shown in FIG. 3, almost closes the passage 44 and therefore limits the consumption of compressed air and thereby accelerates the rise in pressure in the hollow passage 42. Since the operating pressure is then re-established, the valve 16 resumes its position on its seats 17 and 18 while the pressure rises in the chamber 39 and the slide valve 21 consequently resumes its rest position shown in FIG. 2. The device is then again ready for operation.

The advantages of the device are as follows:

Since the gas blast valve 16 is of small size and is subject to large forces, it operates very rapidly. This makes it possible to shorten the circuit-breaking time of the device.

The movement of the skirt 24 caused by the slide valve 21 which masks the valve seat 18 provides effective mechanical protection for the seat of the valve situated on the gas exit path.

The almost complete closing of the passage 44 at the end arc extinction saves a substantial quantity of compressed air and therefore increases the service time of the device.

I claim:

1. A gas-blast circuit breaker including at least one cut-out chamber, a gas blast-valve mounted within said cutout chamber for axial movement between open and closed position, means defining two seats for said gas-blast valve, one seat of which, when the gas-blast valve is opened, is situated on the blast-gas exit path, the improvement comprising a slide valve, means for mounting said slide valve within said chamber for operative sliding movement relative to said gas-blast valve, means for moving said gas blast-valve from closed to open position, and means responsive to the opening of said gas blast-valve to cause a slightly delayed movement of said slide valve in the same direction as the gas-blast valve and along the same axis to mask said one valve seat situated on the exit path from hot blast-gas flow along said blast-gas exit path, and means for opening said slide valve by compressed gas contained in the gas-blast circuit-breaker.

2. A circuit-breaker according to claim 1, wherein a rod is fixedly mounted axially within said cut-out chamber, said slide valve is slidably mounted on said rod, said rod carries a blast-gas deflector on one end of said rod such that in the rest position, by sliding itself along the common axis of said gas-blast valve and said slide valve, said slide valve is placed beyond the gas-blast valve so that the end of said slide valve which masks said one seat while said gas-blast valve is opening is placed at the level of the bearing point of said gas-blast valve against said one seat.

3. A gas-blast circuit breaker including at least one cut-out chamber, a cylindrical valve casing within said cut-out chamber, a cylinder fixedly coaxially mounted within said valve casing at one end thereof and extending partially towards the other end, means on said valve casing and said cylinder forming, respectively, first and second axially spaced valve seats, a cylindrical gas-blast valve mounted within said valve casing, generally in line with said cylinder and including a flanged portion at one end which contacts said first valve seat of said valve casing when said gas-blast valve is in closed position and said gas-blast valve contacting said second seat of said cylinder, at its opposite end, said seat of said cylinder being situated on a blast-gas exit path when said gas-blast valve is in open position, a cylindrical slide valve slidably mounted within said cylinder and bearing a skirt normally underlying the end of the cylinder bearing said second seat for said gas-blast valve, means normally biasing said blast-gas valve towards closed position, means biasing said slide valve towards closed position, means for moving said gas-blast valve from closed position to open position, and means responsive to the opening of said gas-blast valve to cause a slightly delayed movement of said slide valve in the same direction as said gas-blast valve and along the same axis, such that said skirt masks said second valve seat situated on the exit path from hot blast-gas flow, and means for opening said slide valve by compressed gas contained in the gas-blast circuit breaker.

4. A circuit breaker according to claim 3, further comprising a rod fixedly mounted axially within said cylinder, said slide valve being slidably mounted on said rod, said rod carrying a gas-blast deflector on one end of said rod such that in rest position, by sliding itself along the common axis of said gas-blast valve and said slide valve, said slide valve is placed beyond said gas-blast valve so that the skirt of said slide valve which masks said second seat while said gas-blast valve is opening is placed at the level of the bearing point of said gas-blast valve against said second seat.

* * * * *